US005700343A

United States Patent [19]

Castelli et al.

[11] Patent Number: 5,700,343

[45] Date of Patent: Dec. 23, 1997

[54] PREPARATION OF CYLINDRICAL BLANKET BY SPREADING OF COMPRESSIBLE LAYER

[75] Inventors: Francesco Castelli; Gianpiero Invernizzi, both of Lodi, Italy

[73] Assignee: Reeves Brothers, Inc., Spartanburg, S.C.

[21] Appl. No.: 586,516

[22] Filed: Jan. 16, 1996

[51] Int. Cl.[6] ..... B05D 3/06

[52] U.S. Cl. ..... 156/295; 29/895.32; 29/895.33; 492/52; 492/56; 428/909

[58] Field of Search ..... 156/172, 149, 156/295; 29/895.32, 895.33; 492/50, 51, 52, 56; 428/909

[56] References Cited

U.S. PATENT DOCUMENTS

| | | | |
|---|---|---|---|
| 3,152,387 | 10/1964 | MaCleod | 29/130 |
| 3,795,568 | 3/1974 | Rhodarmer | 101/376 |
| 3,962,394 | 6/1976 | Hall | 264/90 |
| 4,042,743 | 8/1977 | Larson | 428/909 |
| 4,554,040 | 11/1985 | van der Velden | 156/215 |
| 4,681,035 | 7/1987 | Kobler et al. | 101/217 |
| 4,913,048 | 4/1990 | Tittgemeyer | 101/141 |
| 5,183,691 | 2/1993 | Hassell | 118/409 |
| 5,205,215 | 4/1993 | Bresson | 101/217 |
| 5,206,992 | 5/1993 | Carlson | 29/895.32 |
| 5,304,267 | 4/1994 | Vrotacoe et al. | 156/86 |
| 5,316,798 | 5/1994 | Tittgemeyer | 427/409 |
| 5,323,702 | 6/1994 | Vrotacoe et al. | 101/217 |
| 5,334,418 | 8/1994 | Byers | 428/909 |
| 5,352,507 | 10/1994 | Bresson et al. | 428/245 |
| 5,364,683 | 11/1994 | Flint | 428/909 |
| 5,440,981 | 8/1995 | Vrotacoe et al. | 101/217 |
| 5,522,315 | 6/1996 | Behnke | 428/909 |

*Primary Examiner*—Daniel Stemmer
*Attorney, Agent, or Firm*—Pennie & Edmonds

[57] ABSTRACT

A method of manufacturing a cylindrical compressible laminate using the floating knife or knife over roll spreading techniques to apply an inner compressible layer and outer or surface layer of a substantially incompressible material. The coating system includes a coating head to dispense an elastomeric material onto a rotating laminate and a knife blade that is parallel to the axis of rotation to distribute and spread a uniform coating of the elastomeric material. The knife blade can be raised incrementally on each rotation of the laminate so that an additional coating can be applied, until a layer of a desired thickness is obtained. In the preferred embodiment, the coatings are at least partially cured during each rotation.

19 Claims, 2 Drawing Sheets

PREPARATION OF CYLINDRICAL BLANKET BY SPREADING OF COMPRESSIBLE LAYER

FIELD OF THE INVENTION

This invention relates to a method of preparing cylindrical elastomeric articles for use in lithographic printing applications, and in particular to a method of preparing compressible cylindrical printing blankets or rollers for use in offset printing presses.

BACKGROUND OF THE INVENTION

In the process of offset lithographic printing, a rotary cylinder is covered with a cylindrical surface referred to as a "printing plate" that has a positive image area, which is receptive to oil-based inks, but is repellent to water, and a background area that is repellent to the oil-based inks. In operation, the printing plate is rotated so that its surface contacts a second cylinder that is covered with a laminate having an ink-receptive rubber surface, known as a "printing blanket". During the offset printing process, the ink on the image surface of the printing plate transfers, or "offsets," to the surface of the printing blanket. Paper or other sheet stock is passed between a nip formed by the blanket-covered cylinder and a rigid back-up cylinder or another blanket covered cylinder, and the image is transferred from the surface of the blanket to the paper.

During the steps in which the image is transferred from the printing plate to the printing blanket, and, subsequently, from the blanket to the paper, it is important to ensure intimate contact between the two contacting surfaces. This is ordinarily achieved by positioning the blanket-covered cylinder and the supporting cylinder, or another blanket-covered cylinder for contacting the paper, so that there is a fixed interference between the two. Therefore, the rubber-surfaced printing blanket laminate is generally compressed throughout the printing run to a fixed depth, typically about 0.5 to 1.5 mm.

If the printing blanket were constructed of solid rubber, it would bulge, or project radially away from the cylinder axis in the areas adjacent to the nip when subjected to high nip pressure. This is because solid rubber cannot be reduced in volume and is therefore subject to lateral flow. Bulging would, of course, tend to distort the print image as well as possibly wrinkle the paper being printed. Therefore, to eliminate bulging and the distortion of the printed image, compressible printing blankets have been developed.

To make the blanket compressible, a portion of the solid material used in forming the blanket is replaced by a gas, generally air. More specifically, layers beneath the surface of the blanket are constructed so as to contain millions of minute voids, which allow uniform compression to take place. As the voids beneath the area under pressure reduce in volume, they permit vertical compression, rather than lateral bulging, to take place at the cylinder nip.

Conventional offset printing blankets generally include a multi-ply fabric base and a vulcanized elastomeric face. The threads used in forming the fabric entrain a certain amount of air and provide voids. Hence the fabric has a certain amount of compressibility. To enhance the compressibility of such blankets, however, compressible material is generally incorporated within the blanket as a compressible layer or incorporated into the fabric. Those skilled in the art have explored a wide variety of ways in which different open cell structures, closed cell structures, microspheres, and various combinations thereof can be used to prepare compressible layers or fabrics that provide printing blankets having the desired compressibility properties. The numerous teachings of how to make compressible printing blankets include the teachings of Reeves Brothers, Inc. PCT Application No. WO 95/23706; Flint et al., U.S. Pat. No. 5,364,683; Byers et al., U.S. Pat. No. 5,334,418; Larson, U.S. Pat. No. 4,042,743; Shimura, U.S. Pat. No. 4,422,895; Rhodarmer et al., U.S. Pat. No. 3,795,568; Pinkston et al., U.S. Pat. No. 4,015,046; and Burns, U.S. Pat. No. 5,069,958.

In order to assure uniformity of printing, it is also important that compression be maintained uniformly over the entire length of the nip between the printing blanket and the support roll. Another important consideration relates to the handling of the paper or other webs being printed. Cylindrical printing blankets constructed for use in a variety of printing processes have, for example, been produced with a concave outer surface to provide tension profiles across the width and between nips or contact points. Spreader rolls having similar concave outer surfaces are also known in the prior art for use in offset printing applications. The resultant tension profiles thus produced act to spread the web and prevent inward wrinkling.

A typical cylindrical printing blanket is constructed around a rotatable support, typically configured in the form of a sleeve. The outer surface of the support is provided with a coating of a "primer," which serves to bond the blanket to the support, and to prevent wicking of materials such as grease, oil, water, ink, etc. upwardly from the support into the blanket. A compressible layer is formed upon the coated support by wrapping the support with one or more threads coated with an admixture of an elastomeric matrix and a plurality of compressible open or closed cells. The elastomeric material is applied to the thread by drawing the thread through a bath of the elastomeric material in a dip tank. The amount of material on the thread is controlled by drawing the thread through an exit hole in the dip tank. The size of the exit hole, which is normally larger than the diameter of the thread, determines the amount of elastomeric material applied to the thread.

During the winding, which is typically applied in a spiral direction, the wrapping conditions are controlled in such a manner that threads sink to the lower portion of the layer, adjacent to the coated support, to form a base portion of the compressible layer. Above this base portion there is only the cell-containing elastomeric material, i.e., without any threads. After the compressible layer is formed, it is at least partially dried or cured by a process known as "precuring". The compressible layer is then wrapped with one or more reinforcing threads coated with an elastomeric matrix that is free of cells. The threads forming this second, reinforcing winding can remain atop the upper surface of the compressible layer due to the effect of the cure. Alternatively, the coated reinforcing threads may be allowed to penetrate the compressible layer to predetermined levels by, e.g., variably decreasing the percent of full cure, or by altering the thread tension. Subsequently, the printing surface, typically, a solid elastomer such as a nitrile blend, is applied to the upper surface of the blanket, atop the coated reinforcing threads.

The prior art methods of producing compressible layers produce a great deal of waste material, and do not provide a consistent product. It is difficult to apply a consistent layer of a uniform thickness or with a desired profile when the material for the layer is provided as a layer of uncured material on thread or yarn used to produce a reinforcing layer. Because the amount of material applied to the thread is only determined by the size of the exit hole in the thread dip tank, there can be large variations in the amount of material deposited. Therefore, the procedure does not allow for the precise control of the amount of material in either the compressible layer or the printing layer because the amount of material applied to the thread can vary greatly.

Therefore, a need exists for a method of manufacturing compressible cylindrical printing blankets that reduces waste, and produces a more consistent product with higher quality. The present invention provides such a method.

SUMMARY OF THE INVENTION

The present invention relates to a method of manufacturing cylindrical, compressible laminates. The claimed method comprises applying a first reinforcing layer onto a cylindrical sleeve, and spreading a compressible layer onto the first reinforcing layer by rotating the sleeve under a coating system, which includes a coating head and a knife blade. An elastomeric matrix coating containing a plurality of open or closed cells, preferably microspheres, is applied onto the first reinforcing layer of the laminate via the coating head, as the knife blade controls the thickness and uniformity of the elastomeric matrix coating, to form a compressible layer on the first reinforcing layer. Finally, a surface layer of a solid elastomeric material is applied, and the layers are cured to form a cured cylindrical compressible laminate on the sleeve.

Typically, a knife blade with a straight edge is used to prepare a compressible layer having uniform thickness across the width of the blanket. However, in an alternative embodiment a compressible layer that is thicker in the center than at the ends of the sleeve can be prepared by spreading the compressible layer with a curved knife blade. Preferably, the compressible layer is applied by incrementally raising the knife blade on each rotation of the sleeve until a compressible layer of a desired thickness is obtained.

A second reinforcing layer may be applied upon the compressible layer before the surface layer is applied. Preferably the first and second reinforcing layers are applied by wrapping yarn, which has been coated with an elastomeric matrix, about the sleeve in a spiral manner to form a series of windings, wherein each winding is substantially in contact with an adjacent winding. The yarn is coated with the elastomeric matrix by drawing yarn through a dip tank containing a bath comprising the elastomeric matrix. Typically, the coated yarn exits the dip tank through an exit hole having a diameter that is substantially the same as the diameter of the yarn.

Preferably, the surface layer is applied by rotating the sleeve under the coating system, wherein the coating head applies an elastomeric matrix upon the surface of the second reinforcing layer of the laminate, and the knife blade controls the uniformity of the surface layer. As with the compressible layer, the surface layer may be applied by incrementally raising the knife blade on each rotation of the sleeve until a surface layer of a desired thickness is obtained.

The outer surface of the sleeve is typically coated with at least one adhesive primer, preferably two adhesive primers, wherein the first adhesive primer is chosen for its adhesion to the sleeve, and the second adhesive primer is chosen for its adhesion to an elastomeric material.

The reinforcing layers preferably comprise a filament, yarn, or thread material, and are typically applied by wrapping yarn or thread, which has been coated with an elastomeric matrix, in a spiral manner to form a series of windings, with each winding of the yarn or thread substantially in contact with an adjacent yarn or thread. In a preferred embodiment, the yarn or thread of the first reinforcing layer is coated with an elastomeric matrix that contains microspheres.

The portion of the compressible layer or of the surface layer that is applied during a single rotation of the laminate may be at least partially cured with infrared radiation during that rotation. In this embodiment, the at least partially cured portion should be cooled before additional elastomeric material is applied thereon; i.e., when the rotation of the sleeve returns the at least partially cured portion to the coating head. Preferably, each portion of applied coating material is cured before additional material is applied.

DETAILED DESCRIPTION OF THE INVENTION

Figure 1:
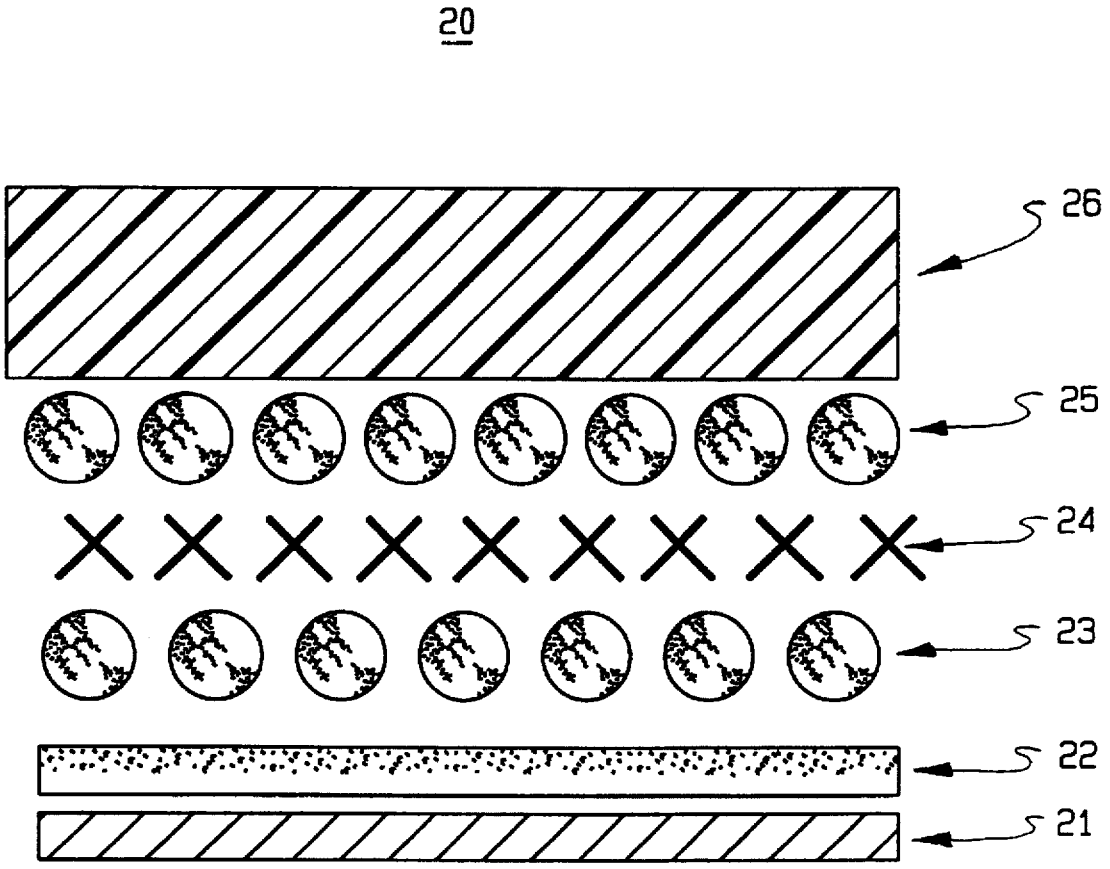
FIG. 1 is an enlarged sectional view through a compressible, cylindrical laminate manufactured according to the present invention.

In its broadest aspect, the present invention contemplates a method of producing a cylindrical compressible elastomeric article for use with or as a cylindrical roll assembly.

The present invention relates to a method of producing cylindrical elastomeric articles for use in printing applications. The articles produced in accordance with the method of the invention comprise a rotatable support, typically, in the form of a sleeve, and a compressible, cylindrical laminate, which has a substantially uniform thickness, mounted upon the support. The laminate comprises a printing face, which forms the outer surface, a compressible layer, positioned beneath the printing face, and at least two reinforcing layers.

The method of the invention comprises applying a first or inner reinforcing layer, preferably in the form of thread or yarn, coated with an uncured rubber material, to a cylindrical sleeve; applying a compressible layer comprising an elastomeric matrix, which contains a plurality of compressible open or closed cells, by a spreading technique; applying a second reinforcing layer, preferably of thread or yarn, and coated with an elastomeric matrix that is substantially free of compressible cells; and applying a surface layer of a solid elastomer by a spreading technique. The elastomeric materials can be at least partially cured as they are applied with the spreading technique, or the completed laminated blanket can be wrapped and cured, and, if necessary, buffed to the desired size, shape, and surface texture.

Preferably, the cylindrical sleeve is metal, most preferably nickel coated copper, and is coated with a first adhesive primer that adheres well to the surface of the sleeve. A second adhesive primer may be applied over the first adhesive primer, and is preferably chosen for its adherence to rubber.

For the purpose of this application the term "yarn" is intended to include any yarn, thread, fiber or filament suitable to reinforce an elastomeric layer in a printing blanket, and the term "laminate" is intended to include completed laminated articles and partially completed laminated articles at any point in the manufacturing process, including adhesive primer coated sleeves.

Preferably, the first reinforcing layer is formed by drawing yarn through a thread dip tank containing a bath comprising a matrix of an elastomeric material, which may contain microspheres or other voids. The coated yarn is drawn through a small exit hole in the dip tank to force the mixture into the yarn. The diameter of the exit hole is close to that of the yarn, so that the yarn either retains only a small coating of the elastomeric matrix on its surface or the elastomeric matrix is forced into the body of the yarn. The small diameter of the exit hole ensures that a consistent amount of the elastomeric material will be applied to the yarn.

The coated yarn is wrapped around the adhesive primer coated sleeve, preferably by rotating the cylinder after an end of the yarn is attached to the sleeve, and drawing the yarn through the bath and the exit hole. The yarn is attached to the sleeve by means of the adhesion between the adhesive primer and the coated yarn. Preferably, one layer of coated yarn is applied to the surface of the sleeve in a spiral manner, such that each successive winding of the yarn is substantially in contact with the previous winding. The process continues until a belt of coated yarn is formed over substantially all of the surface of the adhesive coated sleeve.

The compressible layer of the laminate is then formed over the coated yarn belt using a technique known as spreading. The wrapped sleeve is mounted below a coating system, and rotated at an appropriate speed as the elastomeric material is applied. The coating system includes a coating head to apply an elastomeric material and an adjustable knife blade, which is positioned parallel to the axis of rotation of the laminate and at or near the surface of the coated sleeve, to spread and distribute the elastomeric material. The thickness of each coating of material that forms the portion of the compressible layer that is deposited during a single rotation of the sleeve is determined by the position of the knife blade relative to the surface of the laminate.

The elastomeric matrix that forms the compressible layer may contain microspheres or other voids, and is dispensed from the coating head across the width of the laminate, and is spread by the knife blade as the laminate rotates. This distributes the elastomeric matrix to a uniform thickness over the surface of the sleeve with a minimum of waste, as the amount of material deposited and spread on the laminate is precisely controlled so that only the amount of material required is deposited. With each rotation of the sleeve, the knife is raised an incremental amount to apply another coating of elastomeric material, until a compressible layer of a desired thickness is formed.

As it is advantageous to produce a compressible layer that is slightly thicker in the center than at the ends of the sleeve, a knife blade that is slightly curved with a raised center can be used to achieve this configuration.

In the preferred embodiment, each coating of elastomeric material that forms the portion of the compressible layer that is deposited during a single rotation of the laminate is at least partially cured during that rotation. Preferably, infrared lamps or other infrared radiation sources are used to cure each coating during a single rotation of the laminate. The outer surface of the laminate should be cooled to an appropriate temperature before the next portion of the compressible layer is applied. Therefore, fans or other cooling devices may be used to blow air across the at least partially cured laminate to cool the surface of the laminate before each rotation is completed and the laminate receives a subsequent coating. The infrared sources and fans are typically mounted around the sleeve in a manner that will result in the desired amount of curing during the time that is provided by each full rotation of the sleeve.

After the compressible layer is applied to the coated sleeve and cured, a second reinforcing layer is applied in the same manner as the first reinforcing layer, except that the elastomeric material is substantially free of voids or microspheres. In addition, the size and type of yarn used for the second reinforcing layer may be the same or different from that of the first reinforcing layer.

Finally, the surface or printing layer, typically a nitrile-latex composition free of any voids, is applied to the surface by spreading, using the spreading technique described for the application of the compressible layer. The surface layer may be at least partially cured as it is applied. Alternatively, the completed laminate may be wrapped with a fabric that shrinks when heated, such as nylon, and then cured at vulcanization temperatures. The nylon fabric prevents the formation of pinholes that are formed by gas escaping from the layers of the blanket during the curing cycle. After cooling, the blanket can be ground or buffed to the desired size, shape, and surface.

In an article produced in accordance with the method of the invention, the compressible layer or the surface layer may be either flat or profiled or shaped into a variety of configurations by varying the profile of the knife blade, including, but not limited to, a circular, parabolic, or other curved profile, a central step, optionally including tapered sides, a plurality of graduated steps, a diamond shape, or a center portion which is flat and end portions which radially taper toward the ends of the laminate.

Advantageously, in the invention described above the support is a shaft and the compressible laminate forms a roller on the shaft. Alternately the support is a printing cylinder and the compressible laminate comprises a cylindrical printing blanket mounted upon the printing cylinder.

FIG. 1 is an enlarged, sectional view of a compressible cylindrical laminate manufactured according to the method of the invention. The cylindrical laminate (20) comprises a cylindrical sleeve (21), which is coated with at least one or, preferably, two layers of adhesive primer (22). In the preferred embodiment of the invention, the first layer of primer is chosen for its adhesion to the sleeve material, which is generally a metal, and the second layer of primer is chosen for its adhesion to the elastomeric material used in subsequent layers. A reinforcing layer (23), preferably yarn coated with a matrix of an elastomeric material, is wrapped around the primer coated sleeve (21, 22), such that each winding of coated yarn is substantially in contact with the previous, adjacent winding. Reinforcing layer (23), which forms a base layer for the laminate, is coated with a matrix of an elastomeric material and microspheres or other voids to form a compressible layer (24) using the technique known as spreading. The compressible layer (24) may be at least partially cured, and is then wrapped with a second reinforcing layer (25) of yarn coated with an elastomeric material that is substantially free of voids. Finally, a surface layer (26) of elastomeric material is applied to the reinforcing layer (25) by spreading, and is cured and optionally ground or buffed to the desired shape and surface texture.

The sleeve, upon which the blanket is mounted, provides support for the laminate, is preferably constructed of metal, and is most preferably nickel or nickel plated copper. However, the sleeve may also be formed from a variety of other materials, including, but not limited to, plastics, phenolic resins, fabrics and heavy papers, such as cardboard.

The primer layer prevents corrosion of metal sleeves, as well as adsorption and wicking of fluids, such as inks, water, oils and solvents, upwardly into the blanket from the sleeve. Adhesive primers suitable for the present invention include organic polymeric solutions, such as Chemlock 205 and Chemlock 220. When two layers of adhesive primer are used, the first adhesive primer is preferably Chemlock 205 and the second adhesive primer is Chemlock 220.

The compressible layer comprises an elastomeric material, such as nitrile, Thiokol, fluoroelastomers, and similar solvent resistant materials, preferably nitrile elastomers, and contains about 1 to 15%, and most preferably about 8%, of thermoplastic microspheres, such as Expancel 461 DE, manufactured by Expancel, which is a terpolymer of about 40% acrylonitrile, about 59% vinylidene chloride, and about 1% methyl methacrylate, containing 30 to 70% voids. Other types of microspheres can be used, if desired.

The surface is typically formed from a high durometer, high tensile, low elongation elastomeric compound, such as nitrile, Thiokol, fluoroelastomers, and similar solvent resistant materials, preferably a nitrile blend. The surface is provided to enhance the physical properties of the laminate, and provide a stable printing face, thus, resulting in improved print quality and durability. The surface also serves to improve the resistance of the printing face to cutting while the blanket is in use, making the blanket less susceptible to swelling and delamination, due to penetration by liquids such as inks, oils and solvents.

Yarns suitable for the reinforcing layers include cotton thread, polyester, polyamide, fiberglass, polynostic, aramidic, carbon fibers, and the like, preferably cotton. The diameter of a typical yarn is not critical, and one skilled in the art can easily determine the yarn required to obtain the desired level of reinforcement.

Figure 2:
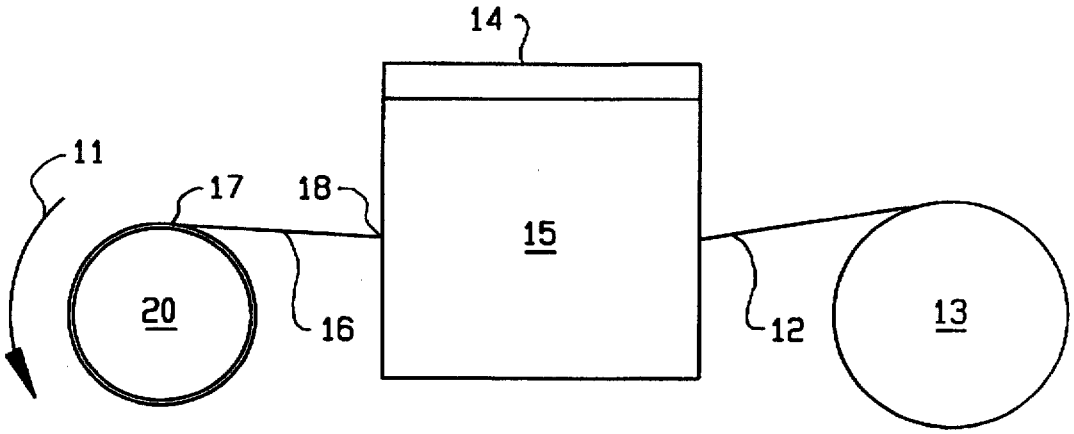
FIG. 2 is a schematic illustration of the preferred method of forming the reinforcing layers of the invention.

The preferred method of forming the reinforcing layers is shown schematically in FIG. 2. Laminate (20) is rotated in the direction of arrow (11) to draw yarn (12) from yarn supply (13) through dip tank (14), which contains a bath comprising a matrix of an elastomeric material (15), providing coated yarn (16). The rotation of laminate (20) also winds coated yarn (16) around laminate (20) to form reinforcing layer (17). Coated yarn (16) exits dip tank (14) through exit hole (18), which has a diameter that is substantially the same as that of the uncoated yarn (12), and ensures that a consistent amount of elastomeric material (15) is applied to yarn (12) to provide a coated yarn (16).

As coated yarn (16) is wound onto laminate (20) to form reinforcing layer (17), the rotational speed of the laminate is chosen to provide a constant peripheral speed of about 40 to about 60 surface meters per minute (smm), preferably about 50 to about 55 smm, most preferably about 52 smm. Therefore, the rotational speed required for winding a reinforcing layer depends on the diameter of the coated sleeve, and a large diameter sleeve will be rotated more slowly than a small diameter sleeve.

Figure 3:
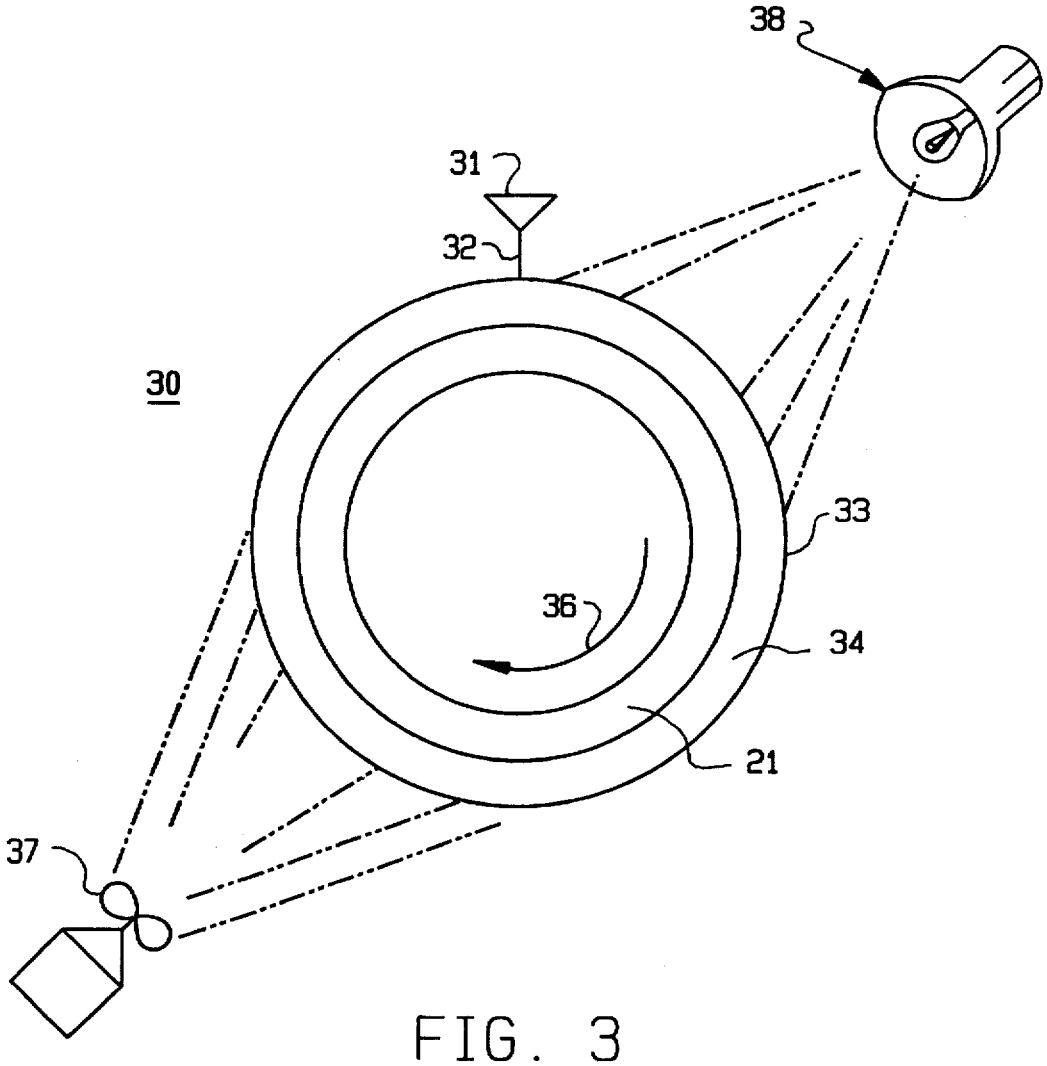
FIG. 3 is a schematic illustration of the spreading technique of the invention.

The spreading technique of the present invention is illustrated schematically in FIG. 3. Both the compressible layer and the top layer are spread onto the surface of the laminate with a coating system (30), which comprises a coating head (31) and a knife blade (32), which is located beneath the coating head (31). The compressible layer is formed by dispensing a coating compound, comprising an elastomeric matrix and a plurality of compressible open or closed cells, at coating head (31), as the surface (33) of the laminate (34) mounted on sleeve (21) passes beneath the coating system (30) as the laminate (34) rotates in the direction indicated by arrow (36). The surface layer is formed in a similar manner, except that the composition of the elastomeric material differs, and is substantially free of any type of voids.

The position of the knife relative to the laminate (34) is adjustable, preferably with computer control. The knife blade (32), which is parallel to the axis of rotation of the laminate (34), can be set so it does not contact the rotating surface (33), or the knife blade (32) can be set to float or ride over the rotating surface (33), which is generally known to those skilled in the art as "floating knife." Preferably, the knife blade is set at a predetermined setting, typically about 0.05 mm, in a technique known as "knife over roll." As the laminate (34) is rotated beneath the head coating system (30), the coating compound is dispensed across the width of the laminate, and distributed and spread in a uniform thickness over the surface (33) by the knife blade (32), forming a coating that forms a portion of the compressible layer. The thickness of the knife blade (32) can range from about 15 to 32 mm. Typically, the "floating knife" position is utilized during the initial rotation of the laminate (34) to avoid damaging the reinforcing layer. The "knife over roll" technique is then used to build up the coating to a desired thickness, typically about 0.1 to about 0.6 mm.

Preferably, each coating of the elastomeric material that makes up the compressible layer is at least partially cured during each rotation of the laminate. Typically, infrared lamps (38) or other infrared sources are mounted so that each coating of the compressible layer is at least partially cured as the laminate makes a single rotation. At least one fan (37) is positioned to cool the partially cured surface before the rotation of the cylinder returns the partially cured surface to the coating system. To at least partially cure the laminate, the surface is typically heated to a temperature of about 90° to about 120° C., preferably about 102° C., as the cylinder and laminate are rotated at about 10 to about 20 rpm, preferably 16 rpm. The surface should be cooled to a temperature of about 30° to about 70° C., preferably about 50° C. before each rotation is completed and another coating of the elastomeric matrix that makes up the compressible layer or the surface layer is applied.

The knife blade is initially set at about 0.01 to about 0.1 mm, preferably about 0.05 mm, above the yarn layer. Then as each rotation of the laminate is completed, the knife blade (32) is raised by about 0.01 to 0.1 mm, preferably about 0.05 mm, so that another coating of the elastomeric matrix that makes up a portion of the compressible layer can be applied. This process continues until a compressible layer with a thickness of about 0.2 to 0.6 mm, preferably about 0.4 mm, is formed.

After the compressible layer is applied upon the first reinforcing layer and cured, a second reinforcing layer is applied in the same manner as the first reinforcing layer, except that the elastomeric material that coats the yarn is substantially free of voids. Preferably, as with the first reinforcing layer, a cotton yarn is used.

Finally, the surface or printing layer, typically a nitrile-latex blend free of any voids, is applied to the surface by spreading, in essentially the same manner as the compressible layer. The knife blade is initially set at about 0.01 to 0.1 mm, preferably about 0.05 mm, above the laminate. Then, as each rotation of the laminate is completed, the knife blade (32) is raised by about 0.01 to 0.1 mm, preferably about 0.05 mm, so that another coating of the surface or printing layer can be applied. This process continues until a surface or printing layer with a thickness of about 0.1 to 0.6 mm, preferably about 0.35 mm, is formed.

Again, as with the compressible layer, infrared lamps or other infrared sources may be used to at least partially cure each coating of the surface layer as the laminate makes a single rotation, and fans can be positioned to cool the partially cured surface before the rotation of the laminate returns the partially cured surface to the coating system. To at least partially cure the surface layer of the laminate, a coating is typically heated to a temperature of about 120° to 160° C., preferably about 140° to 145° C., as the laminate is rotated at about 10 to 20, preferably, 16 rpm. A coating should be cooled to a temperature of about 50° to 100° C., preferably about 75° C. before each rotation is completed and another coating of the surface layer is applied.

If further curing is required, the laminate may be wrapped with a fabric, such as nylon, which shrinks when heated, to prevent the formation of pinholes that are formed by gas escaping from the layers of the blanket, and cured at vulcanization temperatures. After cooling, the blanket can be buffed to the desired size, shape, and surface.

The article produced in accordance with the invention has an external surface that is of substantially uniform circumference across its width, and includes a compressible layer that has a depth and/or void volume that may be substantially flat or may be greater in the central region of the article than it is toward the outer periphery thereof. As used herein, the term "void volume" refers to the total uncompressed volume of all the open and/or closed cells incorporated into the compressible layer. As noted above, the greater the depth and/or void volume of the compressible layer, the more compressibility the layer has.

The compressible layer of an article produced in accordance with the invention is commonly embodied in articles which are generally known and referred to as printing blankets or printing rollers. A printing blanket generally comprises several layers, which are laminated into a single unitary structure. A description of the various layers which may be included in the present invention are described in Flint et al., U.S. Pat. No. 5,364,683, the content of which is expressly incorporated herein by reference thereto.

A wide variety of printing blankets are known in general to those skilled in the art. However, printing blankets constructed in accordance with the present invention have a substantially uniform thickness across their widths, despite the fact that their compressible layers may have a degree of compressibility that is greater in the central region of the blanket than at the outer periphery.

In addition to printing blankets, the principles of the present invention may also be applied to other similar printing and papermaking machine components, such as impression blankets, plate cushions, spreader rollers and support and calendaring rollers.

Although the preferred embodiments of the invention have been specifically described, it is contemplated that changes may be made without departing from the scope or spirit of the invention, and it is desired that the invention be limited only by the appended claims.

What is claimed is:

1. A method of manufacturing a cylindrical, compressible laminate, which comprises, applying a first reinforcing layer onto a cylindrical sleeve;

spreading a compressible layer onto the first reinforcing layer by rotating the sleeve under a coating system, which system includes a coating head and a knife blade, by applying an elastomeric matrix coating containing a plurality of open or closed cells onto the first reinforcing layer of the laminate via the coating head as the sleeve is rotating while utilizing the knife blade to control the thickness and uniformity of the applied elastomeric matrix coating to form the compressible layer thereon, wherein the compressible layer is applied in portions by incrementally raising the knife blade on each rotation of the sleeve until a compressible layer of a desired thickness is obtained;

heating that portion of compressible layer which is applied during one rotation of the sleeve before subsequent portions are applied to at least partially cure the elastomeric matrix coating;

applying a surface layer; and curing the layers to form a cured cylindrical compressible laminate on the sleeve.

2. The method of claim 1, which further comprises applying a second reinforcing layer upon the compressible layer before the surface layer is applied.

3. The method of claim 2, wherein the surface layer is an elastomeric material applied by rotating the sleeve under the coating system, wherein the coating head applies an elastomeric matrix upon the surface of the second reinforcing layer of the laminate, and the knife blade controls the thickness and uniformity of the surface layer.

4. The method of claim 3, wherein the surface layer is applied by incrementally raising the knife blade on each rotation of the sleeve until a surface layer of a desired thickness is obtained, and by heating each portion of the surface layer which is applied during one rotation of the sleeve before subsequent portions are applied to at least partially cure the elastomeric matrix coating.

5. The method of claim 4, wherein each portion of the surface layer which is applied during one rotation of the sleeve is at least partially cured by heating with infrared radiation.

6. The method of claim 5, which further comprises cooling the partially cured portion of the surface layer before applying additional elastomeric matrix material thereon.

7. The method of claim 3, wherein that portion of each layer applied during one rotation of the sleeve is at least partially cured before a subsequent layer portion is applied thereon.

8. The method of claim 2, wherein the first and second reinforcing layers each comprises yarn.

9. The method of claim 2, further comprising applying the first and second reinforcing layers by wrapping yarn, which has been coated with an elastomeric matrix, about the sleeve in a spiral manner to form a series of windings, wherein each winding is substantially in contact with an adjacent winding.

10. The method of claim 9, wherein the yarn is coated with an elastomeric matrix that contains microspheres.

11. The method of claim 9, further comprising coating the yarn with the elastomeric matrix by drawing yarn through a dip tank containing a bath comprising the elastomeric matrix.

12. The method of claim 1, further comprising coating the outer surface of the sleeve with at least one adhesive primer.

13. The method of claim 12, further comprising coating the outer surface of the sleeve with first and second adhesive primers, wherein the first adhesive primer is chosen for its adhesion to the sleeve, and the second adhesive primer is chosen for its adhesion to an elastomeric material.

14. The method of claim 1, wherein each portion of the compressible layer which is applied during one rotation of the sleeve is at least partially cured by heating with infrared radiation.

15. The method of claim 14, which further comprises cooling the partially cured portion of the compressible layer before applying additional elastomeric matrix material thereon.

16. The method of claim 1 wherein each portion of the compressible layer is heated to a temperature of about 90° to about 120° C., as the sleeve and first reinforcing layer are rotated at about 10 to about 20 rpm.

17. A method of manufacturing a cylindrical, compressible laminate, which comprises:

applying a first reinforcing layer onto a cylindrical sleeve by coating a yarn with the elastomeric matrix by drawing the yarn through a dip tank containing a bath comprising an elastomeric matrix, drawing the coated yarn through an exit hole in the dip tank, wherein the exit hole has a diameter substantially the same as that of the yarn, and wrapping the coated yarn about the sleeve in a spiral manner to form a series of windings, wherein each winding is substantially in contact with an adjacent winding, to form the first reinforcing layer;

spreading a compressible layer onto the first reinforcing layer by rotating the sleeve under a coating system, which system includes a coating head and a knife blade by applying an elastomeric matrix coating containing a plurality of open or closed cells onto the first reinforcing layer of the laminate via the coating head as the sleeve is rotating while utilizing the knife blade to control the thickness and uniformity of the applied elastomeric matrix coating to form the compressible layer thereon;

applying a surface layer; and curing the layers to form a cured cylindrical compressible laminate on the sleeve.

18. The method of claim 17, which further comprises applying a second reinforcing layer upon the compressible layer before the surface layer is applied, said second reinforcing layer being applied onto the first reinforcing layer by coating a yarn with the elastomeric matrix by drawing the yarn through a dip tank containing a bath comprising an elastomeric matrix, drawing the coated yarn through an exit hole in the dip tank, wherein the exit hole has a diameter substantially the same as that of the yarn, and wrapping the coated yarn about the first reinforcing layer in a spiral manner to form a series of windings, wherein each winding is substantially in contact with an adjacent winding, to form the second reinforcing layer.

19. A method of manufacturing a cylindrical, compressible laminate, which comprises:

applying a first reinforcing layer onto a cylindrical sleeve;

spreading a compressible layer onto the first reinforcing layer by rotating the sleeve under a coating system, which system includes a coating head and a knife blade, by applying an elastomeric matrix coating containing a plurality of open or closed cells onto the first reinforcing layer of the laminate via the coating head as the sleeve is rotating while utilizing the knife blade to control the thickness and uniformity of the applied elastomeric matrix coating, and forming the compressible layer to be thicker in the center than at the ends of the sleeve by spreading the compressible layer with a curved knife;

applying a surface layer; and curing the layers to form a cured cylindrical compressible laminate on the sleeve.

* * * * *